US008450653B2

(12) United States Patent
Taplan et al.

(10) Patent No.: US 8,450,653 B2
(45) Date of Patent: May 28, 2013

(54) OVEN MUFFLE

(75) Inventors: Martin Taplan, Rheinböllen (DE); Thomas Zenker, Nieder-Olm (DE); Wolfgang Schmidbauer, Mainz (DE); Sascha Backes, Rüdesheim (DE); Helga Goetz, Heidesheim (DE)

(73) Assignee: Schott AG, Mainz (DE)

( * ) Notice: Subject to any disclaimer, the term of this patent is extended or adjusted under 35 U.S.C. 154(b) by 881 days.

(21) Appl. No.: 12/455,306

(22) Filed: May 29, 2009

(65) Prior Publication Data

US 2009/0301461 A1 Dec. 10, 2009

(30) Foreign Application Priority Data

May 29, 2008 (DE) ..... 10 2008 025 886

(51) Int. Cl.
*A21B 1/06* (2006.01)
*F24C 7/04* (2006.01)
*F24C 15/22* (2006.01)

(52) U.S. Cl.
USPC ..... 219/405; 219/391; 219/411; 126/19 R

(58) Field of Classification Search
None
See application file for complete search history.

(56) References Cited

U.S. PATENT DOCUMENTS 3,088,453 A * 5/1963 Grahn et al. ..... 126/273 R
3,612,825 A * 10/1971 Chase et al. ..... 219/405
3,665,915 A * 5/1972 Katona et al. ..... 126/200
3,692,015 A * 9/1972 Chase et al. ..... 126/200
6,320,164 B2 * 11/2001 Millett ..... 219/391
6,392,203 B1 * 5/2002 Schmidmayer ..... 219/405
7,294,811 B2 * 11/2007 Kawashima et al. ..... 219/405
8,017,889 B2 * 9/2011 Adamski ..... 219/400
2001/0023864 A1 * 9/2001 Millett ..... 219/391
2002/0079306 A1 * 6/2002 Gros et al. ..... 219/396
2005/0109335 A1 * 5/2005 Beck et al. ..... 126/198
2008/0190911 A1 * 8/2008 Adamski ..... 219/400
2009/0320824 A1 * 12/2009 Henn et al. ..... 126/500

FOREIGN PATENT DOCUMENTS

CA 2183498 5/1997
DE 33 02 794 A1 8/1984
DE 35 27 957 C2 2/1987
DE 35 27 958 C2 2/1987
DE 102 03 607 A1 7/2003
DE 102 03 609 A1 7/2003
DE 102 03 610 A1 7/2003

(Continued)

OTHER PUBLICATIONS

JP11083027A, Mar. 1999, Ando et al, partial translation and descriptoin of figures.*

(Continued)

*Primary Examiner* — Joseph M Pelham
(74) *Attorney, Agent, or Firm* — Pauley Petersen & Erickson

(57) ABSTRACT

An oven muffle having a receiving space, at least some regions of which are delimited by wall elements, in which at least one of the wall elements is permeable to IR radiation or has a region that is permeable to IR radiation. In the oven muffle, the cooking performance is successfully improved while also providing an easily cleanable interior because a reflecting element that reflects IR radiation is positioned in the region of the outer surface of the wall element on a side oriented away from the receiving space.

30 Claims, 3 Drawing Sheets

FOREIGN PATENT DOCUMENTS

| | | | | |
|---|---|---|---|---|
| DE | 102004008849 | | * | 9/2004 |
| EP | 0 416 030 | B1 | | 3/1991 |
| JP | 11083027 | A | * | 3/1999 |
| JP | 2000334887 | A | * | 12/2000 |
| JP | 2002267175 | A | * | 9/2002 |
| WO | WO 00/40912 | | | 7/2000 |

OTHER PUBLICATIONS

Co-Pending U.S. Appl. No. 12/455,305, filed May 29, 2009; inventors Wolfgang Schmidbauer et al.; title Oven Muffle.

* cited by examiner

OVEN MUFFLE

BACKGROUND OF THE INVENTION

1. Field of the Invention

This invention relates to an oven muffle having a receiving space, at least some regions of which are delimited by wall elements, in which at least one of the wall elements is permeable to IR radiation or has a region that is permeable to IR radiation.

2. Discussion of Related Art

Electrically heated ovens for freestanding ranges or for installation in a kitchen unit are known and essentially include an enameled oven muffle, which is heated from above and below with tubular heating elements. On the front side, the oven muffle is closed by a framed glass door. Usually, the upper heating system is positioned on the interior of the oven muffle and in high-end ovens, is also assisted by a second heating element that enables the oven to execute a grilling function. The lower heating element is attached to the outside of the muffle floor. In addition to these standard heating schemes for upper/lower heating and grilling mode, a recirculating air fan is frequently also incorporated into the back wall, which can also have a separate heating ring not only to recirculate air, but also to produce hot air itself. Because of the structural design and the materials used for the heating elements and oven muffle, the heating system as a whole is very sluggish. It takes a very long time for the tubular heating element to come to temperature and to assure a uniform temperature distribution in the oven. In particular, this applies to the lower heating element, which must first heat the muffle floor so that the muffle floor can then transmit the heat to the muffle chamber and to the food being cooked. Because the enameled walls absorb a great deal of the thermal energy produced by the tubular heating element, the whole muffle chamber including the walls is heated until a stationary temperature is reached. In addition to the long preheating time, there is also an additional problem that soiled regions, spattered grease, and the like become very stubbornly baked onto the walls of the oven muffle. Short wave IR radiation has been used to circumvent this shortcoming. A method for using this rapid thermal radiation for baking and frying procedures is described, for example, in PCT International Publication WO 00/40912 A2 and European Patent Reference EP 0 416 030 B1. The use of short wave IR radiation significantly increases the penetration depth into the food being cooked and speeds up the slow transmission of heat into the interior of the food by thermal conduction. A disadvantage of this technology is the use of point and linear heat sources, images of which appear directly on the food if no other optical preventive measures are taken.

A series of inventions attempt to eliminate these disadvantages, for example as taught in German Patent Reference DE 102 03 607 A1. In this case, an additional textured reflective layer mounted outside the translucent cover reflects the linear light source into the baking compartment. In addition, the linear light source also moves transversely in relation to its longitudinal span. The required movement apparatus makes this method very complex. The above-described oven also has a disadvantage that the reflecting wall is embodied in the form of an additional wall situated behind the translucent wall in the cooling conduit. As a result of this design, a part of the energy is carried away by the cooling conduit.

German Patent Reference DE 102 03 609 A1 describes a light wave oven that uses a uniform illumination of the oven chamber by movable linear light sources with a pivotable reflector. This design is very complex from a mechanical standpoint.

The above-described methods also have a disadvantage that they do not accelerate the browning process that requires the long wave portion of the radiation. This disadvantage is described in German Patent Reference DE 102 03 610 A1 and is eliminated through the installation of additional long wave radiation sources with a different color temperature. The additional installation of other radiation sources means that this method is also complex and expensive.

Another known approach is to embody oven walls of glass or glass ceramic. The use of glass ceramic in ovens is known from Canadian Patent Reference CA 2183498, which proposes an oven floor composed of glass ceramic for better cleanability. German Patent Reference DE 33 02 794 A1 describes an oven muffle of glass or glass ceramic, which is heated by printed heating conductors. In this case, it is only possible to produce long wave, slow radiation. German Patent Reference DE 35 27 957 C2 describes an oven muffle of glass ceramic that is detachably assembled and is heated by externally mounted radiant heating elements. The plates are inserted into a supporting or holding frame, and thus the resulting edges and joints, particularly in the lower corner regions of the oven muffle, can only be cleaned with great difficulty. Taking this into account, German Patent Reference DE 35 27 958 C2 discloses an enameled sheet steel muffle, with window openings provided in the side walls, into which the glass or glass ceramic plates are inserted. In this case, the same problem arises because the joints and connections can only be cleaned with difficulty and in addition, a large portion of the muffle chamber is of enameled sheet steel, and as a result the effect of rapid short wave IR radiation is lost.

SUMMARY OF THE INVENTION

One object of this invention is to provide an oven muffle of the type mentioned above but which is easy to clean on the inner surfaces of the wall elements oriented toward the receiving space and also which achieves good cooking results.

This object is attained if an IR radiation-reflective reflecting element is positioned or situated in the region of the outer surface of the wall element oriented away from the receiving space.

The oven muffle according to this invention can be heated by the known light wave technique and eliminates the above-described disadvantages, particularly with respect to uneven illumination and the missing long wave portion of the radiation. The arrangement of the reflecting layer on the outer surfaces of the wall elements makes it possible to embody the inner surfaces as scratch-resistant so that the oven muffle can be easily cleaned, even when it is heavily soiled. In addition, the arrangement of the reflecting layer provides a uniform illumination of the receiving space encompassed by the oven muffle. It is thus possible to achieve good cooking results. The reflection of the short wave IR radiation preferably occurs in the region of or near the outer surfaces and not by a reflecting layer on the inside of the muffle. A coating on the muffle interior would be susceptible to scratching and there would also be the problem of the missing long wave thermal radiation, which is necessary for browning the surface of food. When the outside surface of the muffle is used as a reflector and scattering surface, the inner surface remains smooth and easy to clean and in addition, through a specific adjustment of its transmission and absorption behavior, the wall element can be set so that a desired intrinsic heating produces long wave IR radiation, but suitable steps are taken to scatter and reflect most of the IR radiation.

According to one embodiment of this invention, it is possible for the wall element to be of glass or glass ceramic. These materials have the advantage that they provide a sufficient scratch-resistance on the inner surface oriented toward the interior of the oven muffle.

The transmission and absorption properties of glass ceramic walls can, for example, be attained by adjusting the transmission properties of the glass ceramic itself. It is also possible for absorption elements that absorb IR radiation to be incorporated into and/or mounted onto the wall element. For example, it is possible to use decorative colors that are baked into the surface of the wall elements. These can control the absorption behavior of the wall element in another region. This permits the missing long wave portion of the radiation to be deftly produced through selective intrinsic heating of the wall elements.

The absorption elements can be used to selectively influence both the short wave and the long wave IR radiation.

According to one embodiment of this invention, the absorption elements can be arranged to form zones with different absorption behaviors. This makes it possible to selectively adjust the absorption behavior of the oven muffle. In accordance with the desired distribution and absorption of the wall elements, the decoration can be homogeneously applied, either distributed on individual wall elements or over all of the wall elements. The decoration can thus be provided over the entire surface or over only partial regions of the wall elements and can also be provided in the form of partial patterns with varying distribution spacing on one or more wall elements. This makes it possible to produce a virtually limitless variety of absorption structures on the wall elements. In addition, the absorption behavior of the employed decorative color can also be used to further influence the absorption. For example, by using different decorative colors, it is possible to control the absorption behavior of the absorption elements between 10% and 90%.

The decoration can be applied so that the absorption elements, embodied in the form of decorative elements, are applied in a layer to the wall element, for example by screen printing or electrophotographic printing. Screen printing methods make it possible to carry out precise, reproducible printing in large batch sizes. Electrophotographic methods permit an economical printing of smaller and mid-sized batches.

If the absorption elements are of print-applied ceramic paints, then the absorption elements are sufficiently durable, in particular scratch-resistant, to be applied to the inside of wall elements without their function being impaired when the oven muffle is cleaned.

In one embodiment of this invention, one or more structural elements for producing scattered radiation each is provided in the region of or near the outer surface of the wall element. The structural elements provide for a uniform distribution and thus illumination of the entire interior of the oven muffle. It is also possible to use the arrangement and/or embodiment of the structural elements to selectively form zones with different intensities of illumination on the interior. Thus, the structural elements can be employed to control the illumination of the interior with short wave IR radiation.

The structural elements can be produced for a low production cost if the structural elements are formed onto the wall element and are of one piece with it.

An oven muffle according to this invention is preferably equipped so that a heating element is positioned outside the receiving space, in the region of or near the outer surface of at least one of the wall elements. This further improves the cleanability of the interior. In an embodiment that is particularly suitable for the desired functionality of the oven muffle, it is possible to use heating elements to produce IR radiation with a wavelength of less than 1.4 μm. This short wave radiation penetrates deep into the food and effectively reduces the cooking time. Using glass ceramic as a material for the wall element makes it possible to achieve a high level of permeability for this IR radiation.

BRIEF DESCRIPTION OF THE DRAWINGS

This invention is explained in view of exemplary embodiments shown in the drawings, wherein.

DETAILED DESCRIPTION OF THE INVENTION

Figure 1:
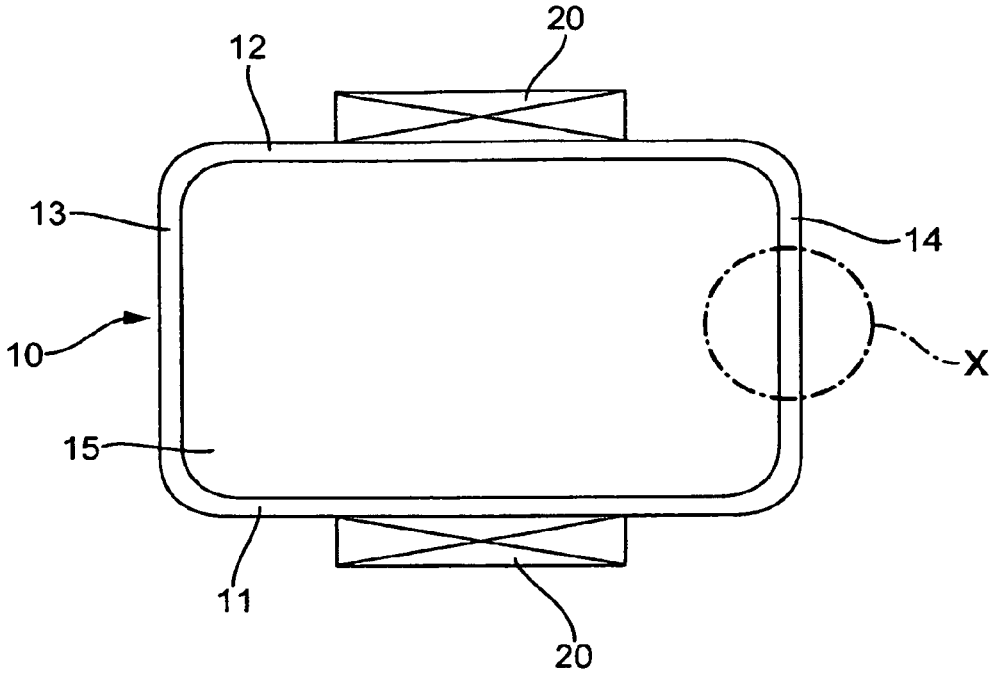
FIG. 1 is a schematic front view of an oven muffle.

FIG. 1 shows an oven muffle that encloses an interior, which serves as a cooking space. The interior is delimited by five wall elements 11-15, a bottom wall element 11, a top wall element 12, two vertical side wall elements, and one rear wall element 15. Outside of the interior, a respective heating element 20 is positioned or situated on the outer surface of the bottom wall element 11 and the outer surface of the top element 12. The heating elements 20 are preferably composed of or are of halogen heating elements. It is also possible to use halogen lamps and normal resistance wire to produce different wavelengths. Another option is to use inexpensive strip heaters of the type employed in glass ceramic cook tops. In addition, heating elements 20 can be provided behind the side wall elements 13, 14 and/or the rear wall element 15 to improve energy distribution in the interior of the oven muffle. This embodiment has an advantage that with a stacked arrangement of several baking trays, it is possible to achieve a good illumination of the interior and radiating action on all of the food.

FIGS. 2 through 7 show possible embodiments of the wall elements 11 through 15, using the wall element 14 as an example. All of the wall elements 11 through 15 preferably have the same design. It is also possible, however, for the wall elements 11 through 15 to have differently adapted embodiments.

The wall elements 11 through 15 have a plate S serving as a substrate, composed of a glass or preferably a glass ceramic. The plate S here has an inner surface 16 oriented toward the interior of the oven muffle and an outer surface 17 oriented away from the interior. The inner surface 16 borders the entire inward-facing inner surface or side surface of the interior.

Figure 2:
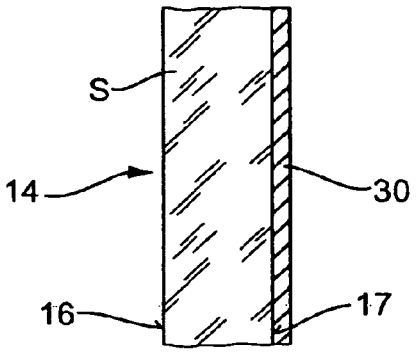
FIGS. 2 through 7 show different embodiments of a wall element in the detail marked with an "X" in FIG. 1.

As shown in FIG. 2, the outer surface 17 of the plate S has a coating, for example a precious metal coating, that functions as a reflecting element 30. The coating is suitable for reflecting IR radiation at least partially into the interior. This coating can, for example, be sprayed on or applied by the sputtering method.

Figure 3:
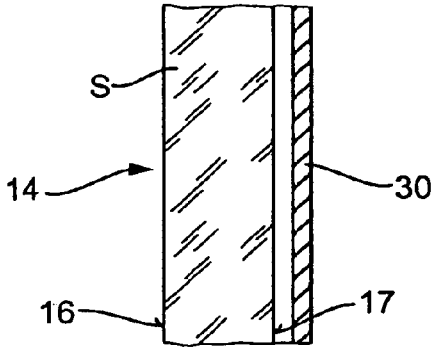

In the embodiment variant shown in FIG. 3, in lieu of the reflecting element 30 in the form of a permanently applied coating, a reflecting foil, preferably aluminum foil, is placed loosely against the outer surface, which can be provided at a significantly lower cost than a reflecting layer permanently applied to the back surface. The reflecting foil can, for example, be glued to the outer surface 17 or placed loosely against it as shown in FIG. 3.

Figure 4:
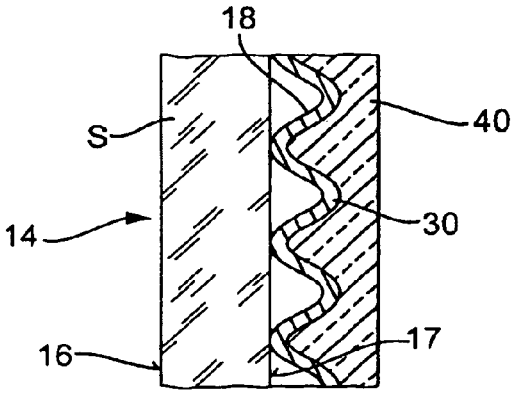

FIG. 4 also shows a loosely applied reflecting foil, preferably aluminum foil, that is textured for scattering IR radiation. The texture can be embossed in various ways, depending on the desired effect. In the present case, the reflecting foil has structural elements 18 that form a wave structure, with uniform wave shapes extending in the direction of the width of the wall element 14. The reflecting element 30 can also be supported by a damping element 40, for example composed of a glass wool or mineral wool. Thus, the reflecting element 30 can be embodied in the form of a sheet-like blank that is laminated onto the damping element 40. It is also possible for the reflecting element 30 to be in the form of a coating applied to the surface of the damping element 40.

Figure 5:
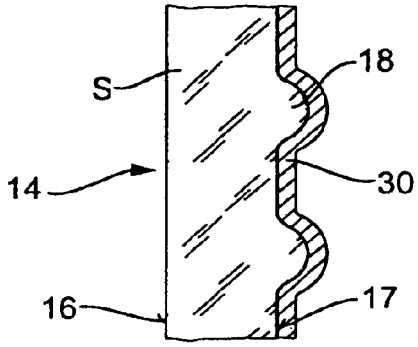

FIG. 5 shows a glass ceramic with a permanent reflecting layer mounted on a rear surface as in FIG. 2, but in this case, the rear surface is textured, with structural elements 18 in the form of scattering nubs formed onto and of one piece with it, in order to also thus produce a uniform distribution of the IR radiation in the interior, the scattering nubs can be distributed at various points in the same distribution pattern. It is also possible for the scattering nubs to form rib-like partitions.

Figure 6:
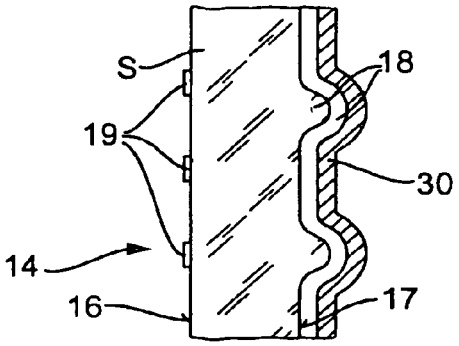

In the wall element 14 according to FIG. 6, a loosely laminated reflecting foil, preferably aluminum foil, is again used on the outer surface. The scattering is again achieved by the textured outer surface of the glass ceramic, as in FIG. 5, and the reflection is achieved by the laminated reflecting foil. As an example for all of the embodiments, this cross section shows an interior decoration of the oven muffle, which is of individually press-applied absorption elements 19 that make it possible to selectively adjust the absorption of the oven muffle. Depending on the desired distribution of absorption elements 19 and the absorption of the wall element 14, the decoration can be applied homogeneously over the entire interior or also only selectively in certain regions, either over the entire surface, or in partial patterns. The decorative colors have an absorption behavior that can be controlled between 10% and 90%.

Figure 7:
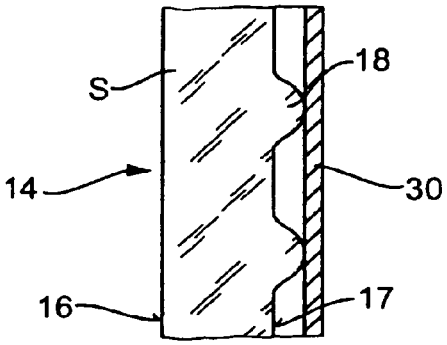

FIG. 7 shows the use of a glass ceramic wall that is textured on the outer surface, similar to the one in FIG. 5, with a reflecting foil, preferably aluminum foil, that is laid against the outer surface 17, as smooth as possible, and assures the reflection of the IR radiation. In this case, the scattering is again assured by the textured outer surface of the plate S, which has structural elements 18 formed onto it. The absorption behavior can be varied within a range from 50% to 90% by the glass ceramic used. This has a very decisive influence on the intrinsic heating of the oven muffle and on the cooking and baking dynamics of the oven. The thickness of the glass ceramic can be used as an additional variation value for influencing the preheating speed and the run-up and cool-down of wall temperatures of the oven muffle and can be selected to be from 2-6 mm, preferably 4 mm. In addition to providing the scattering function by texturing the outer surface 17 of the plate S by structural elements 18 such as nubs or a textured reflecting foil, and the like, it is possible to adjust corresponding crystallite values on order to form intrinsic scattering fields in the glass ceramic itself.

Figure 8:
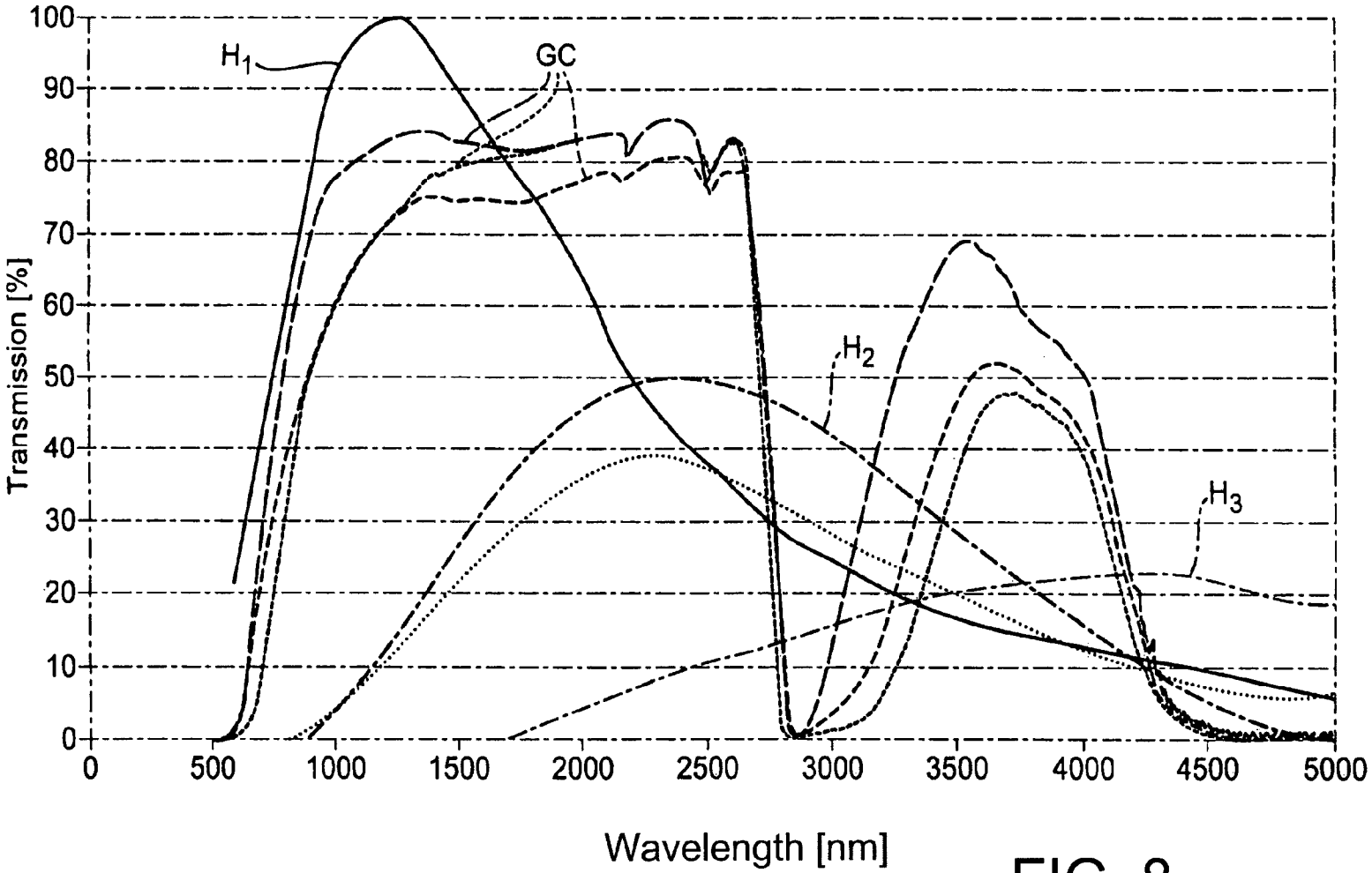
FIG. 8 is a graph in which the transmission of different glass ceramics is plotted over the radiation emission of various heating elements.

By example, FIG. 8 shows the transmission curve of three typical glass ceramics GC in the range from 500-5000 nm and also shows the radiation emission of a radiant heating element with a wire helix or strip H1 of a currently conventional tubular heating element in the grilling mode (1100 K) (H2) and of a tubular heating element during operation with normal top heat (600K). The thorough cooking, with a high penetration depth into the food being cooked, baked, or grilled, is provided by the short wave IR-A radiation up to a wavelength of 1.4 μm. In water, this radiation has a penetration depth of up to 7 cm. In this range, the work is predominantly performed by the preferably employed halogen lamps. The subsequent IR-B radiation lies in the range from 1.4-3 μm. This is the main radiation range of the above-described radiant heating element that is equipped with resistance wire or resistance strips. This is then followed by the IR-C radiation range. This mid-level infrared radiation is responsible for browning of fried or grilled food and is predominantly produced by the tubular heating elements H3 currently in standard use.

The oven according to this invention preferably uses the short wave IR-A radiation, with an advantage that heat begins to act immediately on and in the food being cooked, without having to preheat the oven. The greater penetration depth of the radiation permits the food being cooked to absorb a significantly higher amount of energy per unit time. Trials in the laboratory have demonstrated that this can shorten cooking times by more than 50%, simultaneously also permitting a significant energy savings. Another significant advantage of this type of operation is that the wall elements 11 through 15 remain significantly cooler than the radiant enameled walls of an enameled oven muffle. Dirt thus becomes less intensely baked on, which is another significant advantage of this oven concept. Selectively adjusting the radiation reflection as described above in the various embodiments shown in FIGS. 1 through 7 assures a very homogeneous energy distribution in the interior. The proportion of necessary long wave IR radiation is determined according to this invention by the absorption behavior of the utilized glass ceramic itself or by local partial coatings on the inner surfaces of the wall elements 11 through 15, particularly through the use of decorative colors that are permanently bonded to the glass ceramic surface. Laboratory trials also demonstrated that with the use of short wave IR radiation, a crispy browning of a pork roast is possible even if the roasting pan is covered with a glass lid. In conventional ovens, a crispy surface browning of a pork roast can only be achieved if the roasting pan is uncovered. But in that case, the grease spattered during the process of cooking heavily soils the entire interior of the oven. With the oven according to this invention, a pork roast can be prepared even with a closed glass lid, with the advantage that the interior of the oven does not become soiled with spattered grease.

German Patent Reference 10 2008 025 886.5, filed 29 May 2008, the priority document corresponding to this invention, to which a foreign priority benefit is claimed under Title 35, United States Code, Section 119, and its entire teachings are incorporated, by reference, into this specification.

What is claimed is:

1. An oven muffle comprising a receiving space with at least some regions delimited by wall elements (11-15), at least one of the wall elements (11-15) permeable to IR radiation or having a region permeable to IR radiation, a reflecting element (30) that reflects IR radiation situated near an outer surface (17) of the wall element (11-15) on a side oriented away from the receiving space, at least one structural element (18) for producing scattered radiation each is on the outer surface (17) of the wall element (11-15) and/or in the wall element (11-15), and absorption elements (19) that are separate from the at least one structural element and that absorb IR radiation are inserted into and/or applied onto the wall element (11-15).

2. The oven muffle as recited in claim 1, wherein the wall element is of glass or glass ceramic.

3. The oven muffle as recited in claim 2, wherein a heating element (20) is situated outside the receiving space near the outer surface (17) of at least one of the wall elements (11-15).

4. An oven muffle comprising a receiving space with at least some regions delimited by wall elements (11-15), at least one of the wall elements (11-15) permeable to IR radiation or having a region permeable to IR radiation, a reflecting element (30) that reflects IR radiation situated near an outer surface (17) of the wall element (11-15) on a side oriented away from the receiving space, and absorption elements (19) that absorb IR radiation inserted into and/or applied onto an interior surface of the wall element (11-15).

5. The oven muffle as recited in claim 1, wherein the structural elements (18) are arranged to form zones with different scattering behaviors.

6. The oven muffle as recited in claim 5, wherein the structural elements (18) are formed onto and as one piece with the wall element (11-15).

7. The oven muffle as recited in claim 1, wherein the absorption elements that absorb IR radiation are inserted into and/or applied onto an interior surface of the wall element (11-15).

8. The oven muffle as recited in claim 6, wherein the wall element (11-15) is of glass or glass ceramic and partially absorbs IR radiation.

9. The oven muffle as recited in claim 8, wherein the reflecting element (30) is applied onto the outer surface (17) of the wall element (11-15).

10. The oven muffle as recited in claim 9, wherein the reflecting element (30) is applied in a form of a coating of a precious metal or a metal coating including a silver oxide, a tin oxide, an aluminum oxide, a metal oxide, a tin oxide, an AZO coating, or an ITO coating.

11. The oven muffle as recited in claim 8, wherein the reflecting element (30) is a sheet-like blank, including a form of a reflecting foil situated near the outer surface (17).

12. The oven muffle as recited in claim 11, wherein on a side oriented toward the outer surface (17) of the wall element (11-15) at least a part of the reflecting element (30) has surface texturing.

13. The oven muffle as recited in claim 12, wherein the absorption elements (19) are arranged to form zones with different absorption behaviors.

14. The oven muffle as recited in claim 13, wherein the absorption elements (19) are decorative elements applied in a layer to the wall element (11-15) including by screen printing or electrophotographic printing.

15. The oven muffle as recited in claim 14, wherein the absorption elements (19) are printed-on ceramic paints.

16. The oven muffle as recited in claim 15, wherein the heating element (20) produces IR radiation with a wavelength in a range of less than 1.4 μm.

17. The oven muffle as recited in claim 16, wherein the reflecting element (30) is or is supported by a damping element (40).

18. The oven muffle as recited in claim 1, wherein a heating element (20) is situated outside the receiving space near the outer surface (17) of at least one of the wall elements (11-15).

19. The oven muffle as recited in claim 1, further comprising a plurality of uniformly distributed structural elements (18) for producing scattered radiation disposed near the outer surface (17) of the wall element (11-15) and/or in the wall element (11-15).

20. The oven muffle as recited in claim 19, wherein the structural elements (18) are formed onto and as one piece with the wall element (11-15).

21. The oven muffle as recited in claim 1, wherein the wall element (11-15) is of glass or glass ceramic and partially absorbs IR radiation.

22. The oven muffle as recited in claim 1, wherein the reflecting element (30) is applied onto the outer surface (17) of the wall element (11-15).

23. The oven muffle as recited in claim 1, wherein the reflecting element (30) is a sheet-like blank, including a form of a reflecting foil situated near the outer surface (17).

24. The oven muffle as recited in claim 1, wherein a heating element (20) produces IR radiation with a wavelength in a range of less than 1.4 μm.

25. The oven muffle as recited in claim 1, wherein the reflecting element (30) is or is supported by a damping element (40).

26. The oven muffle as recited in claim 4, wherein at least one structural element (18) for producing scattered radiation each is near the outer surface (17) of the wall element (11-15) and/or in the wall element (11-15).

27. The oven muffle as recited in claim 4, wherein on a side oriented toward the outer surface (17) of the wall element (11-15) at least a part of the reflecting element (30) has a surface texturing.

28. The oven muffle as recited in claim 4, wherein the absorption elements (19) are arranged to form zones with different absorption behaviors.

29. The oven muffle as recited in claim 4, wherein the absorption elements (19) are decorative elements applied in a layer to the wall element (11-15) including by screen printing or electrophotographic printing.

30. The oven muffle as recited in claim 4, wherein the absorption elements (19) are printed-on ceramic paints.

* * * * *